US010172386B2

(12) United States Patent
Besso

(10) Patent No.: US 10,172,386 B2
(45) Date of Patent: Jan. 8, 2019

(54) SMOKING ARTICLE INCLUDING FLOW RESTRICTOR IN HOLLOW TUBE

(71) Applicant: PHILIP MORRIS PRODUCTS S.A., Neuchatel (CH)

(72) Inventor: Clement Besso, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 144 days.

(21) Appl. No.: 15/102,000

(22) PCT Filed: Dec. 29, 2014

(86) PCT No.: PCT/EP2014/079382

§ 371 (c)(1),
(2) Date: Jun. 6, 2016

(87) PCT Pub. No.: WO2015/101605

PCT Pub. Date: Jul. 9, 2015

(65) Prior Publication Data

US 2016/0302477 A1 Oct. 20, 2016

(30) Foreign Application Priority Data

Dec. 31, 2013 (EP) ..... 13199910

(51) Int. Cl.
*A24D 3/04* (2006.01)

(52) U.S. Cl.
CPC ..... *A24D 3/04* (2013.01); *A24D 3/045* (2013.01)

(58) Field of Classification Search
CPC ..... A61M 15/06
See application file for complete search history.

(56) References Cited

U.S. PATENT DOCUMENTS 3,339,557 A * 9/1967 Karalus ..... A24D 3/061 131/274
4,261,354 A * 4/1981 Nelson ..... A61M 15/06 128/203.23

(Continued)

FOREIGN PATENT DOCUMENTS

EP 2253231 11/2010
JP 2010520755 6/2010

(Continued)

OTHER PUBLICATIONS

European Extended Search Report for Application No. 13199910.4-1656 dated Jun. 30, 2014 (5 pages).

(Continued)

*Primary Examiner* — Cynthia Szewczyk
(74) *Attorney, Agent, or Firm* — Mueting, Raasch & Gebhardt, P.A.

(57) ABSTRACT

There is provided a smoking article comprising a filter. The filter comprises a hollow tube having an inner surface. The filter further comprises a flow restrictor disposed in the hollow tube, and adapted to divert at least a portion of the flow of mainstream smoke between an outer surface of the restrictor and the inner surface of the hollow tube. Furthermore, the filter comprises a retaining element disposed downstream of the flow restrictor, the retaining element having one or more openings. Each of the openings of the retaining element has at least one cross-sectional dimension that is smaller than the smallest cross-sectional dimension of the flow restrictor to prevent the flow restrictor from moving downstream of the retaining element. The flow restrictor is substantially spherical, at least one cross-sectional dimension of the one or more openings of the retaining element being smaller than the diameter of the flow restrictor.

20 Claims, 2 Drawing Sheets

(56) References Cited

U.S. PATENT DOCUMENTS

| | | | | |
|---|---|---|---|---|
| 8,109,277 | B2 | 2/2012 | Li | |
| 2006/0272663 | A1* | 12/2006 | Dube | A24D 3/061 131/337 |
| 2007/0235050 | A1 | 10/2007 | Li | |
| 2008/0216853 | A1 | 9/2008 | Li | |
| 2011/0083675 | A1 | 4/2011 | Olegario | |
| 2015/0027477 | A1* | 1/2015 | Yoshino | A24D 3/04 131/337 |

FOREIGN PATENT DOCUMENTS

| | | |
|---|---|---|
| NL | 7805408 | 11/1979 |
| WO | WO 2010/133334 | 11/2010 |
| WO | WO 2011/095410 | 8/2011 |

OTHER PUBLICATIONS

PCT Search Report and Written Opinion for PCT/EP2014/079382 dated May 12, 2015 (8 pages).
Decision to Grant issued in Japanese Patent Application No. 2016-539122 dated Nov. 1, 2018 (6 pages). English translation included.

* cited by examiner

SMOKING ARTICLE INCLUDING FLOW RESTRICTOR IN HOLLOW TUBE

This application is a U.S. National Stage Application of International Application No. PCT/EP2014/079382, filed Dec. 29, 2014, which was published in English on Jul. 9, 2015, as International Patent Publication WO 2015/101605 A1. International Application No. PCT/EP2014/079382 claims priority to European Application No. 13199910.4 filed Dec. 31, 2013.

The present invention relates to a filter for a smoking article, and to a smoking article comprising a filter.

Combustible smoking articles, such as cigarettes, generally comprise shredded tobacco (usually in cut filler form) surrounded by a paper wrapper forming a tobacco rod. A cigarette is employed by a consumer by lighting one end thereof and burning the shredded tobacco rod. The consumer then receives mainstream smoke by drawing on the opposite end (mouth end or filter end) of the cigarette. The shredded tobacco can be a single type of tobacco or a blend of two or more types of tobacco.

A number of smoking articles in which an aerosol forming substrate, such as tobacco, is heated rather than combusted have also been proposed in the art. In heated smoking articles, the aerosol is generated by heating the aerosol forming substrate. Known heated smoking articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool, they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

Smoking articles, particularly cigarettes, generally comprise a filter aligned in end-to-end relationship with a source of material, such as a tobacco rod or another aerosol forming substrate. Typically, the filter includes a plug of cellulose acetate tow attached to the tobacco rod or substrate by tipping paper.

Ventilation of mainstream smoke can be achieved with a row or rows of perforations in the tipping paper about a location along the filter. Ventilation dilutes all of the material flowing through the smoking article. For example, in conventional cigarettes ventilation reduces both the particulate phase and the gas phase constituents of the mainstream smoke. However, smoking articles having high levels of ventilation may have levels of resistance-to-draw (RTD) which can be too low to be considered acceptable to a consumer. The inclusion of, for example, one or more high density cellulose acetate filter segments may be used to increase to an acceptable level the overall RTD of smoking articles with high ventilation. However, while known to efficiently reduce particulate phase (for example, tar) deliveries, high-density cellulose acetate filter segments may affect the flavour notes generated by high quality tobacco. On top of that, high-density cellulose acetate filter segments have little or no effect on gas phase (for example, carbon monoxide) deliveries.

Other filters are also known that include hollow tubes to form a mouth-end cavity or cavities at other locations in the filter. While these filters have little or no effect on the flavour notes, they also have little or no effect on both the gas phase and particulate phase of the mainstream smoke. At the same time, control of air flow and pressure drop may prove more difficult with these filters.

One way to solve this is to include a restrictor element in the filter. For example, WO-A-2010/133334 and US-A-2007/0235050 describe restrictor elements that increase RTD. If used with ventilation, a restrictor element can increase RTD while both the particulate phase and the gas phase constituents of the mainstream smoke are reduced.

It would be desirable to provide a filter for a smoking article that preserves flavour notes so that the consumer's smoking experience is enhanced, while also providing a mechanism for controlling gas phase and particulate phase delivery in the mainstream smoke and maintaining satisfactory values of RTD. Furthermore, it would be desirable to provide one such filter for a smoking article that is also straightforward and inexpensive to manufacture.

According to a first aspect of the invention, there is provided a smoking article comprising a filter, the filter comprising a hollow tube having an inner surface; a flow restrictor disposed in the hollow tube, and adapted to divert at least a portion of the flow of mainstream smoke between an outer surface of the restrictor and the inner surface of the hollow tube; and a retaining element disposed downstream of the flow restrictor, the retaining element having one or more openings; wherein each of the one or more openings of the retaining element has at least one cross-sectional dimension that is smaller than the smallest cross-sectional dimension of the flow restrictor to prevent the flow restrictor from moving downstream of the retaining element. In addition, the flow restrictor is substantially spherical, at least one cross-sectional dimension of the one or more openings of the retaining element being smaller than the diameter of the flow restrictor.

In this specification, the "upstream" and "downstream" relative positions between smoking article components are described in relation to the direction of mainstream smoke as it is drawn from a lit end of the smoking article through the filter component. Smoking articles as described herein comprise a downstream end and an opposed upstream end. In use, a user draws on the downstream end of the smoking article. The downstream end, which is also described as the mouth end, is downstream of the upstream end, which may also be described as the distal end or the lit end.

In the filter of the smoking article according to the invention, the standard filtration material used in many prior art filters may be substantially replaced, from a structural and functional viewpoint, by a flow restrictor disposed in a hollow tube. The mainstream smoke is thus diverted towards the periphery of the hollow tube and directed to flow around the flow restrictor. This raises the RTD to a satisfactory level. Because the flow restrictor is preferably moveable within the hollow tube, a retaining element may be provided downstream of the hollow tube to prevent the flow restrictor from falling out and from potentially reaching the consumer's mouth. In practice, the retaining element is a structural component that is designed to obstruct part of the downstream mouth of the hollow tube, so that air and smoke can flow through it, without it causing any further, substantial increase in the RTD, while the flow restrictor is safely retained within the hollow tube.

Preferably, the flow restrictor is impermeable to air and smoke, so air and smoke drawn through the smoking article are forced to flow through a passageway defined between the inner periphery of the hollow tube and the outer surface of the restrictor. This is advantageous because it allows appropriate values of RTD and air flow to be obtained with minimal loss of flavour note of the tobacco. Furthermore, because the flow restrictor is disposed in the hollow tube between the downstream end of the tobacco rod or aerosol forming substrate and the mouth end of the filter, undesirable particles such as tobacco particles can be effectively prevented from reaching the consumer's mouth.

The flow restrictor may be solid or may comprise a shell and a core. The core may be empty. The flow restrictor may have any suitable shape. For example, the flow restrictor may be substantially spherical, ovoid, ellipsoid, spheroid, cylindrical, prism-shaped or teardrop-shaped. In a preferred embodiment, however, the flow restrictor is substantially spherical. A spherical flow restrictor is easy to manufacture and, since it is radially symmetrical, its orientation within the hollow tube is not important.

The flow restrictor preferably comprises an air-impermeable material. The expression "air-impermeable material" is used throughout this specification to mean a material not allowing the passage of fluids, particularly air and smoke, through interstices or pores in the material. If the flow restrictor comprises a material impermeable to air and smoke, air and smoke drawn through the filter are forced to flow around the flow restrictor and through a passageway of reduced cross section.

By reducing the cross-sectional area available for air and smoke flowing through the filter, the flow restrictor increases the RTD to a level that is acceptable to a consumer. Diverting the flow towards the edge of the filter may be particularly effective in increasing RTD since air and smoke flow may be predominantly through the central portion of the filter. The size and shape of the flow restrictor in relation to the inner diameter of the hollow tube may be selected to provide the desired RTD. The flow restrictor may be able to generate a RTD of at least about 150 mm $H_2O$ (about 1470 Pa), preferably at least about 200 mm $H_2O$ (about 1960 Pa), even more preferably at least about 250 mm $H_2O$ (about 2450 Pa). Alternatively or in addition, the flow restrictor may be able to generate a RTD of less than about 500 mm $H_2O$ (about 4900 Pa), preferably less than least about 400 mm $H_2O$ (about 3920 Pa), even more preferably less than about 350 mm $H_2O$ (about 3430 Pa). In some preferred embodiments, the flow restrictor generates a RTD between approximately 150 mm $H_2O$ (about 1470 Pa) and 500 mm $H_2O$ (about 4900 Pa), preferably between approximately 200 mm $H_2O$ (about 1960 Pa) and 400 mm $H_2O$ (about 3920 Pa), more preferably between approximately 250 mm $H_2O$ (about 2450 Pa) and 350 mm $H_2O$ (about 3430 Pa).

The RTD generated by the flow restrictor may be assessed as the negative pressure that has to be applied, under test conditions as defined in ISO 3402, to the output end of the filter section containing the hollow tube with the restrictor, in order to sustain a steady volumetric flow of air of 17.5 ml/s through the filter section, having blocked any ventilation off. In the context of this application, if the filter comprises any filter segments other than the one containing the hollow tube with the restrictors, those are removed prior to carrying out the measurement. At the downstream end of the hollow tube a retaining element is provided in the form of a pair of pins projecting radially from the periphery of the tube and having a length such as to prevent the flow restrictor to roll out of the hollow tube. The cross sectional area of the passageway left available for air and smoke by this retaining element is so large with respect to the passageway defined between the flow restrictor and the hollow tube that the RTD value measured is practically unaffected by its presence.

In some embodiments, the flow restrictor may be arranged loosely within the hollow tube. In other words, the flow restrictor may have dimensions such as to be free to move within the hollow tube. Thus, air and smoke drawn through the filter are directed to flow through a passageway defined between the outer surface of the flow restrictor and the lateral wall of the hollow tube. In these embodiments, therefore, the cross-sectional area available for air and smoke flowing around the flow restrictor can be estimated as the difference between the transverse cross-sectional area of the hollow tube and the transverse cross-sectional area of the flow restrictor, regardless of the shape of the flow-restrictor.

The expression "transverse cross-sectional area" of an element of the smoking article is used throughout this specification to mean the area of a surface formed by a plane cutting across the element transversely, and especially perpendicularly, to the longitudinal axis of the smoking article. Thus, with a spherical flow restrictor, the cross-sectional area available for air and smoke to flow through may be regarded as being substantially or approximately annular-shaped.

For example, in those embodiments where the flow restrictor is arranged loosely within the hollow tube, the cross-sectional area available for air and smoke flowing around the flow restrictor may be from about 0.70 square mm to about 1.15 square mm. Preferably, the cross-sectional area available for air and smoke flowing around the flow restrictor is from about 0.71 square mm to about 1.13 square mm. More preferably, the cross-sectional area available for air and smoke flowing around the flow restrictor is from about 0.81 square mm to about 1.03 square mm. Even more preferably, the cross-sectional area available for air and smoke flowing around the flow restrictor is from about 0.85 square mm to about 0.98 square mm.

By way of example, if the flow restrictor is spherical and has a diameter of about 8 mm, the hollow tube has preferably an internal diameter from about 8.06 mm to about 8.08 mm. Even more preferably, the flow restrictor is spherical and has a diameter of about 8.07 mm.

In other embodiments, the flow restrictor may be substantially wedged inside the hollow tube. In other words, the flow restrictor may have dimensions such as to engage with the hollow tube. Further, a plurality of grooves is formed on the outer surface of the flow restrictor to define a passageway for air and smoke to flow through. In the alternative, or in addition, grooves may be formed in the inner surface of the hollow tube. Thus, air and smoke drawn through the filter are preferentially directed to flow along the grooves formed in the periphery of the flow restrictor or in the inner surface of the hollow tube.

Preferably, the equivalent transverse cross-sectional area of the passageway defined by the grooves in the periphery of the flow restrictor is also in the same ranges described above with reference to the cross-sectional area available for air and smoke in the case of embodiments with a flow restrictor disposed loosely within the hollow tube.

The flow restrictor may engage with the hollow tube, for example, by resistance created by friction force between the flow restrictor and the inner surface of the hollow tube. In particular, at least one cross-sectional dimension of the flow restrictor may be larger than the inner diameter of the hollow tube such that the flow restrictor engages with, and is wedged inside, the hollow tube.

If both the flow restrictor and the hollow tube have circular cross sections, this corresponds to the inner diameter of the hollow tube being slightly smaller than the diameter of the flow restrictor. Therefore, the permeable cross-sectional area is given by the sum of the cross-sectional areas of all the separate passageways defined between each groove formed in the periphery of the flow restrictor or the inner surface of the inner tube.

In particular, the inner diameter of the hollow tube may be between about 75 percent and about 99 percent of the at least one cross-sectional dimension of the flow restrictor. Preferably, the inner diameter of the hollow tube is between about 80 percent and about 95 percent of the at least one cross-sectional dimension of the flow restrictor. More preferably, the inner diameter of the hollow tube is between about 88 percent and about 95 percent of the at least one cross-sectional dimension of the flow restrictor.

The at least one cross-sectional dimension should be measured in a direction which ensures that the flow restrictor is retained stably in the hollow tube by friction. Preferably, the at least one cross-sectional dimension is measured in the direction of the inner and outer diameters of the hollow tube when the flow restrictor is disposed in the hollow tube.

The longitudinal position of the flow restrictor wedged within the hollow tube may be selected to accommodate the other structural elements of the smoking article such as ventilation. For example, the longitudinal position of the centre of the flow restrictor wedged in the hollow tube may be at least about 9.5 mm from the mouth end of the hollow tube. Alternatively or in addition, the longitudinal position of the centre of the flow restrictor wedged in the hollow tube may be less than about 18 mm from the mouth end of the hollow tube. In a preferred embodiment, the longitudinal position of the centre of the flow restrictor wedged in the hollow tube is about 12 mm from the mouth end of the hollow tube. In this specification, by "centre" of the flow restrictor reference is made to the mid-point between the extent of the flow restrictor disposed closest to the downstream end of the hollow tube and the extent of the flow restrictor disposed closest to the upstream end of the hollow tube.

Preferably, the flow restrictor is non-compressible. The term "non-compressible" is used throughout this specification to mean resistant to compression from any of: manual handling, as the smoking article is removed from a pack; digital compression (that is, by a user's fingers on the filter); buccal compression (that is, by a user's lips or teeth on the mouth end of the filter); or the manual extinguishing ("stubbing out") process. That is, the term "non-compressible" is used to mean not deformable or destructible in the normal handling of a smoking article during manufacture and use.

Preferably, the flow restrictor has a compressive yield strength greater than about 8.0 kPa. More preferably, the flow restrictor has a compressive yield strength greater than about 12.0 kPa. The compressive yield strength is defined as the value of uniaxial compressive stress reached when there is a permanent deformation of the flow restrictor.

Preferably, the flow restrictor has a compressive strength at a deformation of 10 percent greater than about 50.0 kPa. The compressive strength at a deformation of 10 percent is defined as the value of uniaxial compressive stress reached when there is a 10 percent deformation (that is, a 10 percent change in one cross-sectional dimension) of the flow restrictor.

The compressive yield strength and the compressive strength at a deformation of 10 percent may both be obtained experimentally by means of standardized test ISO 604. As will be appreciated by the skilled person, in this test, the specimen (flow restrictor) is compressed by compressive plates along an axis that corresponds to the pressure that a smoker's fingers would exert on the restrictor when the smoker is grasping the smoking article. The test is conducted at a constant rate of displacement until the load or deformation reaches a predetermined value. The load sustained by the specimen (flow restrictor) is measured during the procedure.

The flow restrictor may comprise any suitable material or materials. Preferably, the flow restrictor comprises one or more air-impermeable materials. Examples of suitable materials include, but are not limited to, gelatine or other types of hydrocolloids, alginate, carboxymethyl cellulose (CMC), cellulose, starch, polylactic acid, poly(butylene succinate) and its copolymers, poly(butylene adipate-co-terephthalate) and combinations thereof. The flow restrictor may comprise compressed tobacco, tobacco dust, ground tobacco, other flavourants or a combination thereof.

Preferably, the flow restrictor is formed from a dissolvable polymeric material formed of one or more water soluble polymers. More preferably the dissolvable polymeric material is formed of one or more water soluble thermoplastics. The term "dissolvable" means that the polymeric material is capable of dissolving into a solution with a water solvent. This is achieved through the use of one or more water soluble materials to form the material. The flow restrictor may be made entirely of the dissolvable polymeric material or the dissolvable polymeric material may be combined with inert components, such as inert inorganic fillers, which may or may not be dissolvable. The use of a dissolvable material to form the flow restrictor advantageously increases the rate of disintegration of the filter after it has been discarded. Alternatively or additionally, the flow restrictor may comprise a material which disperses into a suspension or colloid with the addition of water.

More preferably, the flow restrictor is formed from a biodegradable polymeric material. Preferred polymers are fully biodegradable as defined in the Aqueous Aerobic Biodegradation Test (Sturm test) outlined in European standard EN13432. Preferred biodegradable polymers include starch.

The hollow tube may comprise any suitable material or materials. Furthermore, the hollow tube may comprise a coating layer on an inner surface thereof. A coating layer can help to inhibit absorption of moisture into the tubular member during smoking of a smoking article, therefore maintaining the resistance of the filter to deformation. Suitable coating materials include, but are not limited to, waxes, polymeric materials and combinations thereof. Particularly suitable waxes include vegetable waxes, and other particularly suitable materials are ethylcellulose and nitrocellulose.

In some embodiments, the hollow tube may be formed from a polymeric material or a paper material. For example, the hollow tube can be formed from extruded plastic tubes. In other embodiments, the hollow tube is formed from a plurality of overlapping paper layers, such as a plurality of parallel wound paper layers or a plurality of spirally wound paper layers, which can further increase the resistance of the tubular member to deformation or collapse. More preferably, the hollow tube comprises at least two paper layers. Alternatively, or additionally, the tubular member preferably comprises fewer than eleven paper layers.

An exemplary method for forming a hollow tube from a plurality of wound paper layers comprises wrapping a plurality of substantially continuous paper strips in an overlapping manner about a cylindrical mandrel. The strips are wrapped in a parallel manner or a spiral manner so as to form a substantially continuous tube on the mandrel. The formed tube may be turned about the mandrel, for example using a rubber belt, so that the paper layers are continually drawn and wrapped around the mandrel. The formed tube can then be cut into hollow tubes of the required length downstream of the mandrel.

To inhibit the transfer of moisture from one paper layer to the next during smoking of a smoking article incorporating the filter, adjacent paper layers of a hollow tube are preferably adhered together by an intermediate layer of adhesive, which provides a barrier to the transfer of moisture between layers. This may be in addition to or as an alternative to a coating provided on an inner surface of each tubular member, as described above. Such a coating may additionally, or alternatively, be provided between adjacent layers of the tubular member.

In smoking articles and filters for smoking articles according to the invention, it is important that roundness and stiffness of the hollow tube are such that insertion of the flow restrictor is made simple and convenient. In particular, deformations of the hollow tube are undesirable. Accordingly, it is desirable that the hollow tube have a very low ovality after deformation. This advantageously provides consistency in the ovality of the inner cavity of the filter during smoking of the smoking article. The particular test procedure for assessing deformation of the filter in accordance with present invention is described in detail below.

The term "ovality" as used herein means the degree of deviation from a perfect circle. Ovality is expressed as a percentage and the mathematical definition is given below.

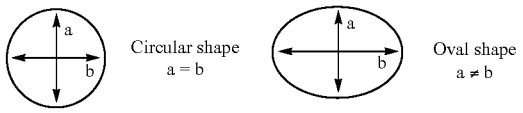

$$\text{ovality (\%)} = \frac{2(a-b)}{a+b} \times 100\%$$

To determine the ovality of the hollow tube segment, the tube is removed from the smoking article as cleanly as possible and the mouth end is viewed along the longitudinal direction of the tube. For example, the hollow tube can be positioned on its mouth end on a transparent stage so that an image of the mouth end of the tube is recorded by a suitable imaging device located below the stage. Dimension "a" is taken to be the smallest external diameter of the hollow tube segment at the middle of the hollow tube segment, and dimension "b" is taken to be the largest external diameter of the hollow tube segment at the same position along the hollow tube segment. The process is repeated for a total of ten tubes having the same design and the number average of the ten ovality measurements is recorded as the ovality for that design of hollow tube.

Where it is necessary to measure the ovality after deformation tests performed both before and after smoking, two samples of smoking articles having the same design should be used. That is, a non-deformed un-smoked smoking article should be used for the pre-smoking deformation test, and non-deformed articles having the same design are subjected to the smoking test and used for the post-smoking deformation test.

The retaining element is adapted to stop the flow restrictor from moving downstream and out of the hollow tube. In practice, the retaining element is configured to obstruct part of the downstream mouth of the hollow tube, so that the flow restrictor is prevented from falling out of the filter and from potentially reaching, in use, the consumer's mouth. At the same time, the retaining element is designed so as to not substantially contribute to increasing the RTD of the smoking article.

The retaining element has one or more openings allowing the passage of fluids, particularly of air and smoke. The number, shape and size of the one or more openings in the retaining element are preferably selected to define a passageway having an equivalent available cross-sectional area such that the retaining element only marginally increases the RTD. By equivalent available cross-sectional area, reference is made here to the sum of the cross-sectional areas of all the one or more openings in the retaining element.

Preferably, the retaining element may be adapted to generate a RTD in the range of approximately 1 mm $H_2O$ (about 10 Pa) to approximately 20 mm $H_2O$ (about 200 Pa). Preferably, the retaining element is adapted to generate a RTD between approximately 2 mm $H_2O$ (about 20 Pa) to approximately 10 mm $H_2O$ (about 100 Pa).

Further, each of the one or more openings of the retaining element has at least one cross-sectional dimension that is smaller than the smallest cross-sectional dimension of the flow restrictor, whereby the flow restrictor is prevented from moving downstream of the retaining element.

The one or more opening of the retaining element may have any suitable shape, provided that, if a flow restrictor loosely arranged inside the hollow tube moves towards the retaining element and partly obstructs one or some of the one or more openings, a sufficient passageway remains available for air and smoke, such that the RTD is not substantially increased, while the flow restrictor is safely maintained inside the hollow tube.

In some embodiments, the retaining element may be integral with the hollow tube. In particular, the retaining element may comprise a retaining portion extending from the lateral wall of the hollow tube and partly obstructing the downstream mouth of the hollow tube. For example, the retaining portion may be substantially annular shaped and define an opening having a cross-sectional dimension smaller than the inner diameter of the hollow tube. For example, the one or more opening of the tubular segment may be circular, oval, triangular, polygonal, square, star-shaped, heart-shaped, cross-shaped, etc. In other embodiments, the retaining element may comprise a segment separate from and disposed downstream of the hollow tube.

In one embodiment, the retaining element may simply comprise projections projecting radially from the periphery of the tube, for example a pair of pins projecting radially from the periphery of the tube and having a length such as to prevent the flow restrictor to roll out of the hollow tube. The cross sectional area of the passageway left available for air and smoke by this retaining element is so much larger than the cross-sectional area available for air and smoke to flow between the restrictor and the hollow tube, that the overall RTD of the filter is practically unaffected by the presence of this retaining element.

In other embodiments, the retaining element may be substantially shaped as a spoke wheel and comprise a plurality of rod-like element (spokes) projecting radially from the periphery of the tube and joining at a central hub element. Preferably, the spokes are equally spaced around the longitudinal axis of the hollow tube. In a preferred embodiment, the retaining element may comprise three spokes.

In other embodiments, the retaining element may comprise a tubular segment separate from and disposed downstream of the hollow tube, the inner diameter of the tubular segment being smaller than the inner diameter of the hollow tube. Thus, the permeable cross-sectional area of the tubular segment is smaller than the permeable cross-sectional area of the hollow tube. Because the tubular segment that acts as a retaining element defines a cavity, the flow restrictor disposed loosely inside the hollow tube upstream of the tubular segment may be visible from the mouth end. Accordingly, a user may be able to visually detect movement of the flow restrictor within the hollow tube.

The downstream tubular segment may have a roughened internal surface, such that the flow restrictor is prevented from engaging with it and, therefore, cannot plug it.

As an alternative, the downstream tubular segment may comprise channels or be made of a porous material, which has pores through which air and smoke can pass without substantially increasing the RTD of the filter, while at the same time being impervious to the flow restrictor. In practice, while being permeable to air and smoke, the porous material only defines passageways that are too narrow or too tortuous or both for the flow restrictor to move through it. As an alternative, the retaining element may consist of a disc or plug comprising a standard low-efficiency porous material, such as cellulose acetate.

In some preferred embodiments, the downstream tubular segment is made of a non-porous material and defines an opening having a shape other than the shape of the cross section of the flow restrictor. For example, if the flow restrictor is spherical, the tubular segment may define an opening having a shape other than circular, such as oval, triangular, polygonal, square, star-shaped, heart-shaped, cross-shaped. Thus, the flow restrictor cannot plug the opening of the tubular segment.

The filter optionally includes one or more additional filter elements upstream of the hollow tube. Further, the filter may include one or more additional filter elements downstream of the hollow tube and the retaining element. The filter may even include one or more additional filter elements upstream and downstream of the hollow tube and the retaining element. For example, the filter may further include a plug or plugs or disc or discs of filter material upstream of the hollow tube, a plug or plugs or disc or discs or filter material downstream of the hollow tube, or plugs or discs of filter material upstream and downstream of the hollow tube. Alternatively or additionally, the filter may further include a tubular element or elements downstream of the hollow tube, a tubular element or elements upstream of the hollow tube, or tubular elements downstream and upstream of the hollow tube. The tubular element or elements may have the same or different dimensions as the hollow tube of filter material. If more than one tubular element is provided, the tubular elements may have the same or different dimensions as each other.

The filter may include a filter wrapper circumscribing at least the hollow tube of filter material. A filter wrapper provides strength and structural rigidity for the hollow tube. This reduces the chance that the hollow tube will be deformed or damaged as the flow restrictor is inserted into the hollow tube. This also reduces the chance that the hollow tube will deform on its outer surface around the region where the flow restrictor is disposed inside the hollow tube. Preferably, where the filter includes one or more additional filter elements, the hollow tube and the one or more additional filter elements are overwrapped with a filter wrapper. The filter wrapper may comprise any suitable material. Preferably, the filter wrapper is a stiff plug wrap, for example comprising stiff paper or cardboard. The stiff paper or cardboard preferably has a basis weight greater than about 60 gsm (grams per square meter). A stiff filter wrapper provides high structural rigidity. The filter wrapper may include a seam including one or more lines of adhesive. Preferably, the seam includes two lines of adhesive. This reduces the chance that the filter wrapper will split open as the flow restrictor is inserted into the hollow tube. One line of adhesive may comprise a hot melt adhesive. One line of adhesive may comprise polyvinyl alcohol.

Preferably, the filter has a length $L_F$ between about 15 mm and about 40 mm. Even more preferably, the filter has a length $L_F$ between about 18 mm and about 30 mm. In one embodiment, the filter has a length $L_F$ of about 27 mm. In a preferred embodiment, however, the filter has a length $L_F$ of about 21 mm. A reduced length is possible because the design of the filter according to the invention allows the desired RTD to be achieved in a short length and with very little, if any, filter material. If the filter does not include additional filter elements upstream or downstream of the hollow tube, the length of the filter is equal to the length of the hollow tube and retaining element. If the filter does include additional filter elements upstream or downstream or both upstream and downstream of the hollow tube, the length of the hollow tube is less than the length of the whole filter. The length of the hollow tube may depend on the additional filter element or elements.

Filters according to the present invention may advantageously be used in filter cigarettes and other smoking articles in which tobacco material is combusted to form smoke. Filters according to the present invention may alternatively be used in smoking articles in which tobacco material is heated, rather than combusted, to form an aerosol. Filters according to the present invention may also be used in smoking articles in which a nicotine-containing aerosol is generated from a tobacco material, tobacco extract, or other nicotine source, without combustion and in some cases without heating.

According to a second aspect of the invention, there is provided a smoking article comprising: an aerosol forming substrate; and a filter according to the first aspect of the invention. Features described in relation to one aspect of the invention may also be applicable to another aspect of the invention.

To connect the filter to a tobacco rod, the smoking article may include a tipping wrapper circumscribing the filter and at least a portion of the tobacco rod. The tipping wrapper may comprise paper having a basis weight of less than about 70 gsm, preferably less than about 50 gsm. The tipping wrapper preferably has a basis weight of more than about 20 gsm.

The tipping wrapper may provide additional strength and structural rigidity for the filter and reduce the chance of deformation on the outer surface of the filter at the location where the flow restrictor is disposed in the hollow tube of filter material. The tipping wrapper may include a ventilation zone comprising perforations through the tipping wrapper. The tipping wrapper may include at least one row of perforations to provide ventilation of the mainstream smoke. If the filter includes a filter wrapper, preferably, the perforations extend through the filter wrapper. Alternatively, the filter wrapper may be permeable. The tipping wrapper may be a standard pre-perforated tipping wrapper. Alternatively, the tipping wrapper may be perforated (for example, using a laser) during the manufacturing process according to the desired number, size and position of the perforations. The number, size and position of the perforations may be selected to provide the desired level of ventilation. The ventilation, in conjunction with the flow restrictor, produces the desired level of RTD.

Preferably, the at least one circumferential row of perforations is at least about 9.5 mm from the mouth end of the hollow tube. Alternatively or in addition, the at least one circumferential row of perforations is less than about 18 mm from the mouth end of the hollow tube. In a preferred embodiment, the at least one circumferential row of perforations is about 12 mm from the mouth end of the hollow tube. In the alternative, or in addition to the above positioning of the perforations, the ventilation zone is placed such that the ventilation air is introduced into the smoking article downstream of the flow restrictor. This provides the optimal mix of ambient air drawn through the perforations and the air and smoke mixture flowing through the filter.

The smoking article described above can be assembled using standard manufacturing equipment. The flow restrictor may be manufactured off-line, for example using a fast continuous process such as a rotary-die process. An object inserting machine may be used for inserting the flow restrictor inside the hollow tube.

The invention will be further described, by way of example only, with reference to the accompanying drawings in which.

Figure 1:
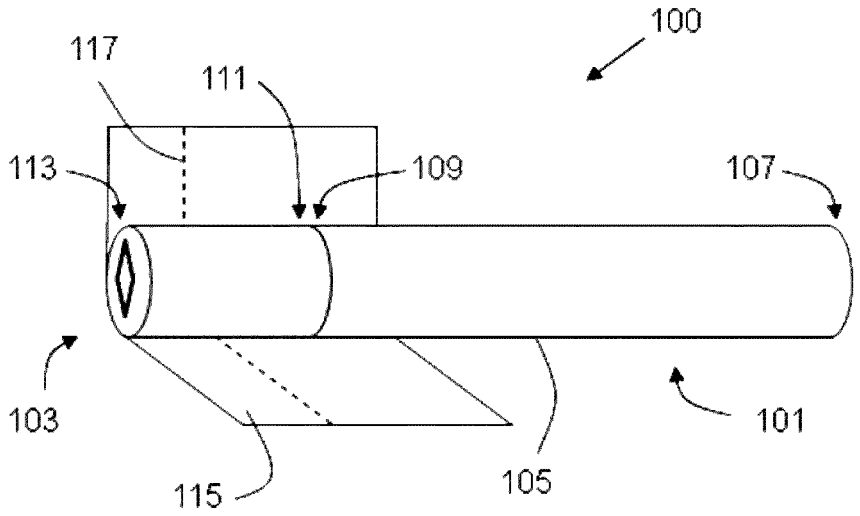
FIG. 1 is a perspective view of a smoking article according to one embodiment of the invention.

FIG. 1 is a perspective view of a smoking article 100 according to one embodiment of the invention. The smoking article 100 includes a generally cylindrical tobacco rod 101 and a generally cylindrical filter 103. The tobacco rod 101 and filter 103 are axially aligned in an end-to-end relationship, preferably abutting one another. The tobacco rod includes an outer wrapper 105 circumscribing the smoking material. The outer wrapper 105 may be a porous wrapping material or. paper wrapper. The tobacco is preferably a shredded tobacco or. tobacco cut filter. The tobacco rod 101 has an upstream, lit end 107 and a downstream end 109. The filter 103 has an upstream end 111 and a downstream, mouth end 113. The upstream end 111 of the filter 103 is adjacent the downstream end 109 of the tobacco rod 101.

The filter component 103 is attached to the tobacco rod 101 by tipping material 115 which circumscribes the entire length of the filter 103 and an adjacent region of the tobacco rod 101. The tipping material 115 is shown partially removed from the smoking article in FIG. 1, for clarity. The tipping material 115 is typically a paper like product. However, any suitable material can be used. In this embodiment, the tipping material 115 includes a circumferential row of perforations 117 aligned with the filter 103. The perforations are provided for ventilation of the mainstream smoke.

In this specification, the "upstream" and "downstream" relative positions between smoking article components are described in relation to the direction of mainstream smoke as it is drawn from the tobacco rod 101 and through the filter 103.

Figure 2:
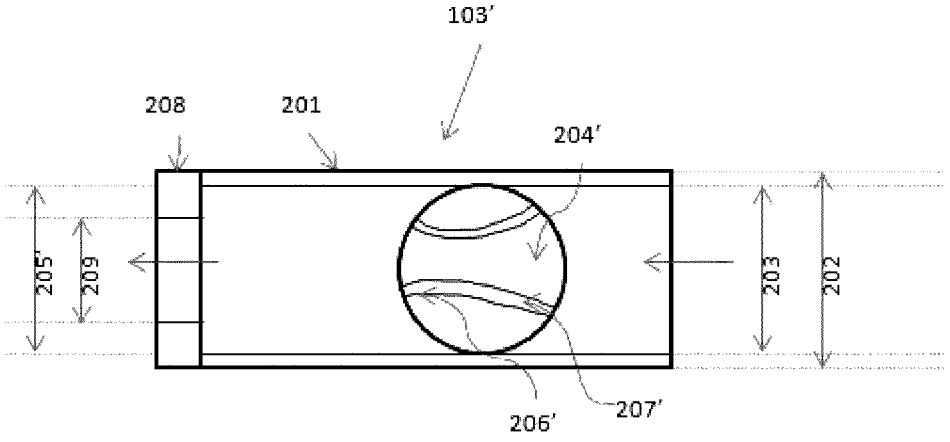
FIG. 2 is a cross-sectional view of a filter according to a first embodiment of the invention.

FIG. 2 is a cross-sectional view of a filter 103' according to a first embodiment of the invention. The filter 103' may be used in the smoking article of FIG. 1. In FIG. 2, the filter 103' comprises a hollow tube 201. The hollow tube 201 has an outer diameter 202 and an inner diameter 203. The filter 103' further comprises a flow restrictor 204'. The flow restrictor 204' is substantially spherical, with a diameter 205'. The flow restrictor 204' is disposed in the hollow tube 201.

Diameter 205' of the flow restrictor 204' is slightly larger than inner diameter 203 of the hollow tube 201, so the flow restrictor 204' causes the wall of the hollow tube 201 to distort slightly and the flow restrictor 204' is maintained wedged inside the hollow tube 201 by friction.

The flow restrictor 204' has grooves 206' formed in its periphery and defining respective passageways 207' permeable to air and smoke between the wall of the hollow tube 201 and the flow restrictor 204'. As shown schematically by the arrows, air drawn through the filter 103' during use of the smoking article is forced to flow around the flow restrictor 204' and through a reduced cross section substantially defined by the passageways 207'.

The filter further comprises a retaining element 208 disposed immediately downstream of the hollow tube 201. The retaining element 208 comprises a pair of opposite pins projecting radially from the periphery of the hollow tube 201 and having a length such as to prevent the flow restrictor 204' to roll out of the hollow tube 201. In more detail, the radially inner ends of the two pins are separated by a distance 209 smaller than the diameter 205' of the flow restrictor 204'.

Figure 3:
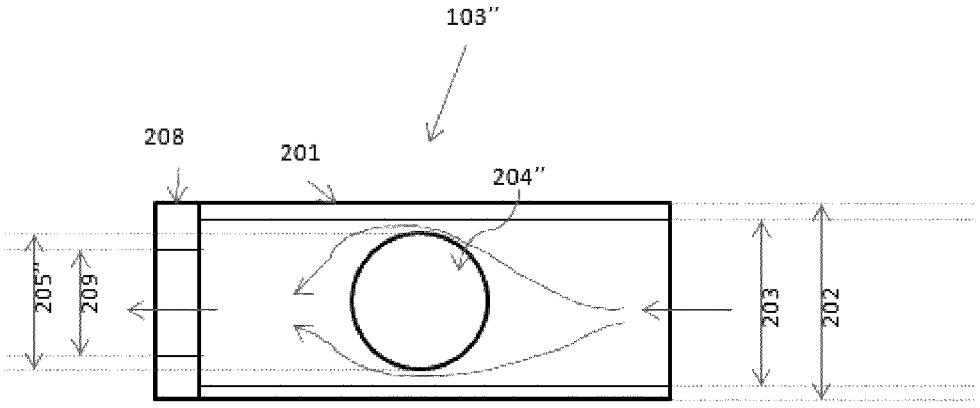
FIG. 3 is a cross-sectional view of a filter according to a second embodiment of the invention.

FIG. 3 is a cross-sectional view of a filter 103" according to a second embodiment of the invention. The filter 103" may be used in the smoking article of FIG. 1. In FIG. 3, the filter 103" comprises a hollow tube 201. The hollow tube 201 has an outer diameter 202 and an inner diameter 203. The filter 103" further comprises a flow restrictor 204". The flow restrictor 204" is substantially spherical, with a diameter 205". The flow restrictor 204" is loosely arranged inside the hollow tube 201.

Diameter 205" of the flow restrictor 204" is slightly smaller than inner diameter 203 of the hollow tube 201, so the flow restrictor 204" is free to move (for example, to roll) inside the hollow tube 201.

The flow restrictor 204" has a substantially smooth outer surface. As shown schematically by the arrows, air drawn through the filter 103" during use of the smoking article is forced to flow around the flow restrictor 204" and through a reduced cross section substantially defined between the outer surface of the flow restrictor 204" and the lateral wall of the hollow tube 201.

The filter further comprises a retaining element 208 disposed immediately downstream of the hollow tube 201. The retaining element 208 comprises a tubular segment made of a non-porous material and defining an opening having a square shape, that is a shape other than the shape of the cross section of the flow restrictor 204'. In more detail, the side of the square-shaped opening of the tubular segment has a length 209 that is smaller than the diameter 205" of the flow restrictor 204". Thus, even when smoke is drawn from the downstream end of the filter 103", the flow restrictor 204" cannot plug the opening of the tubular segment 208.

Neither filter 103', 103" in FIGS. 2 and 3 include additional filter elements upstream or downstream of the hollow tube. However, it will be appreciated that an additional element may be included, for example upstream of the hollow tube, so as to prevent the flow restrictor 103', 103' from contacting the tobacco rod 101 and accidentally being burnt during use of the smoking article by a consumer. For example, a porous plug element may be disposed immediately upstream of the hollow tube 201.

The invention will be further described with reference to the following example.

EXAMPLE 1

In accordance with the measurement procedure outlined above, the generated RTD has been assessed for a smooth-surfaced spherical flow restrictor having a diameter of 8.00 mm loosely disposed within smooth-surfaced hollow tubes having different internal diameters. The results are given in the following table.

| Hollow tube diameter [mm] | Available cross-sectional area [square mm] | RTD [mm $H_2O$] |
|---|---|---|
| 8.05 | 0.630 | 608 |
| 8.06 | 0.757 | 462 |
| 8.07 | 0.883 | 290 |
| 8.09 | 1.137 | 158 |

The invention claimed is:

1. A smoking article comprising:

a hollow tube having an inner surface;

a flow restrictor disposed in the hollow tube, and adapted to divert the flow of mainstream smoke between an outer surface of the restrictor and the inner surface of the hollow tube; and a retaining element disposed downstream of the flow restrictor, the retaining element having one or more openings;

wherein each of the one or more openings of the retaining element has at least one cross-sectional dimension that is smaller than the largest cross-sectional dimension of the flow restrictor to prevent the flow restrictor from moving downstream of the retaining element; and wherein the flow restrictor is substantially spherical, at least one cross-sectional dimension of the one or more openings of the retaining element being smaller than the diameter of the spherical flow restrictor.

2. A smoking article according to claim 1, wherein the transverse cross-sectional area of the flow restrictor is smaller than the transverse cross-sectional area of the hollow tube and larger than the transverse cross-sectional area of the opening.

3. A smoking article according to claim 2, wherein the flow restrictor is adapted to generate a RTD between approximately 150 mm $H_2O$ (about 1470 Pa) and approximately 500 mm $H_2O$ (about 4900 Pa).

4. A smoking article according to claim 2, wherein the retaining element is integral with the hollow tube.

5. A smoking article according to claim 2, wherein the retaining element is provided as a disc or plug comprising a porous material.

6. A smoking article according to claim 2, wherein the flow restrictor comprises one or more air flow grooves on its outer surface.

7. A smoking article according to claim 1, wherein the flow restrictor is adapted to generate a RTD between approximately 150 mm $H_2O$ (about 1470 Pa) and approximately 500 mm $H_2O$ (about 4900 Pa).

8. A smoking article according to claim 7, wherein the retaining element is adapted to generate a RTD between approximately 1 mm $H_2O$ (about 10 Pa) and approximately 20 mm $H_2O$ (about 200 Pa).

9. A smoking article according to claim 1, wherein the retaining element is adapted to generate a RTD between approximately 1 mm $H_2O$ (about 10 Pa) and approximately 20 mm $H_2O$ (about 200 Pa).

10. A smoking article according to claim 1, wherein the cross-sectional area available for the mainstream smoke flowing around the flow restrictor is from about 0.71 square mm to about 1.13 square mm.

11. A smoking article according to claim 1, wherein the cross-sectional area available for the mainstream smoke flowing around the flow restrictor is from about 0.80 square mm to about 1.03 square mm.

12. A smoking article according to claim 1, wherein the retaining element is integral with the hollow tube.

13. A smoking article according to claim 12, wherein the retaining element comprises at least a portion extending from a lateral wall of the hollow tube and partly obstructing the downstream mouth of the hollow tube.

14. A smoking article according to claim 1, wherein the retaining element comprises at least a portion extending from a lateral wall of the hollow tube and partly obstructing the downstream mouth of the hollow tube.

15. A smoking article according to claim 1, wherein the retaining element comprises a tubular segment disposed downstream of the hollow tube, the inner diameter of the tubular segment being smaller than the inner diameter of the hollow tube.

16. A smoking article according to claim 1, wherein the retaining element is provided as a disc or plug comprising a porous material.

17. A smoking article according to claim 1, wherein the flow restrictor comprises one or more air flow grooves on its outer surface.

18. A smoking article according to claim 1, wherein the flow restrictor has a compressive yield strength greater than about 8.0 kPa.

19. A smoking article according to claim 1, wherein the flow restrictor has a compressive strength at a deformation of 10 percent greater than about 50.0 kPa.

20. A filter for a smoking article, the filter comprising:

a hollow tube having an inner surface;

a flow restrictor disposed in the hollow tube, and adapted to divert the flow of mainstream smoke between an outer surface of the restrictor and the inner surface of the hollow tube; and a retaining element disposed downstream of the flow restrictor, the retaining element having one or more openings;

wherein each of the one or more openings of the retaining element has at least one cross-sectional dimension that is smaller than the largest cross-sectional dimension of the flow restrictor to prevent the flow restrictor from moving downstream of the retaining element.

* * * * *